United States Patent [19]

Schön

[11] Patent Number: 4,733,711

[45] Date of Patent: Mar. 29, 1988

[54] FOLDING BLIND, COMPOSITE FOLDING BLIND AND COUPLING STRIP THEREFORE

[76] Inventor: Siegfried Schön, 3, Kwadestraat, 4871 NH Etten-Leur, Netherlands

[21] Appl. No.: 906,391

[22] Filed: Sep. 12, 1986

[30] Foreign Application Priority Data

Sep. 20, 1985 [NL] Netherlands ..... 8502591

[51] Int. Cl.[4] ..... E06B 3/94

[52] U.S. Cl. ..... 160/84.1; 160/279

[58] Field of Search ..... 160/84 R, 115, 169, 160/214, 178 R, 279, 201

[56] References Cited

U.S. PATENT DOCUMENTS

| | | | |
|---|---|---|---|
| 2,836,237 | 5/1958 | Hogin et al. | 160/115 |
| 2,918,121 | 12/1959 | Gibble | 160/115 |
| 4,326,577 | 4/1982 | Tse | 160/279 |
| 4,467,853 | 8/1984 | Downey, Jr. | 160/133 |
| 4,473,101 | 9/1984 | Langeler | 160/279 |
| 4,557,309 | 12/1985 | Judkins | 160/279 |
| 4,574,864 | 3/1986 | Tse | 160/279 |
| 4,625,786 | 12/1986 | Carter | 160/84 R |

FOREIGN PATENT DOCUMENTS

| | | | |
|---|---|---|---|
| 1380051 | 10/1964 | France | 160/178 R |

*Primary Examiner*—Ramon S. Britts
*Assistant Examiner*—David M. Purol
*Attorney, Agent, or Firm*—John P. Snyder

[57] ABSTRACT

A folding blind, consisting principally of a fixed top and bottom beam, and also a parallel thereto slidable along cords intermediate beam to which a panel of pleated material is fastened, whereby the intermediate beam is divided into a first and a second intermediate beam, in which the second intermediate beam is slidable along cords parallel to or with the first one, so being able to provide on the one side a composite folding blind which consists of more than one folding blind, linked above one another or on the other side a panel of material to be fitted between the fixed top and bottom beam and the first and second intermediate beam respectively, so producing in effect two folding blinds.

17 Claims, 9 Drawing Figures

FIG. 3
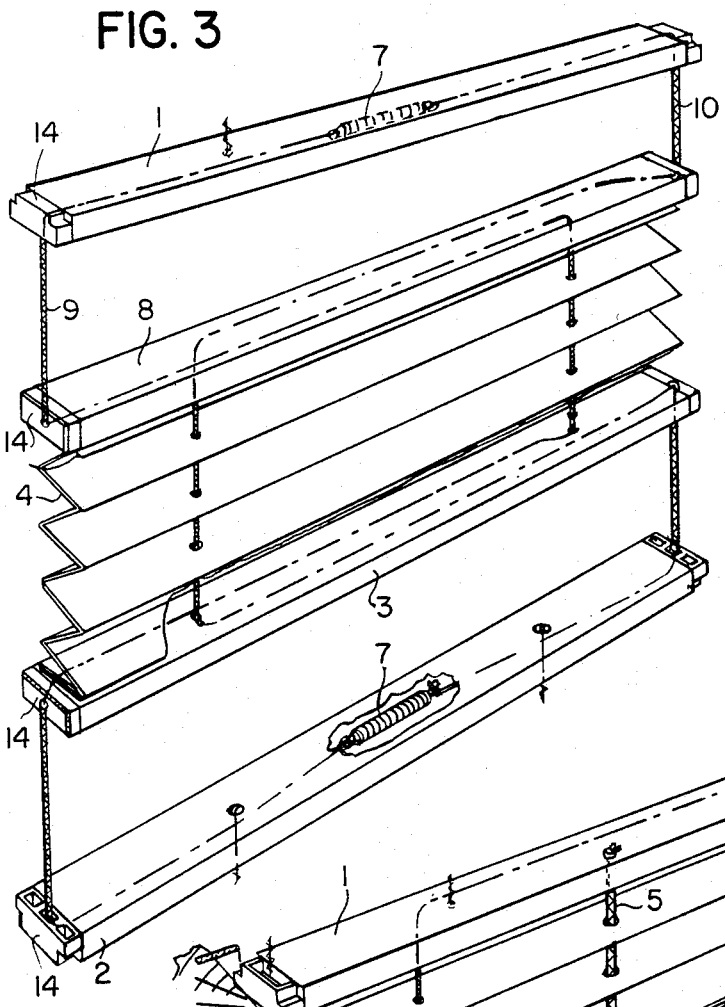
FIG. 2
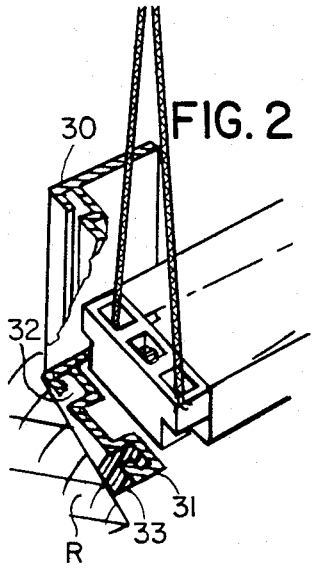
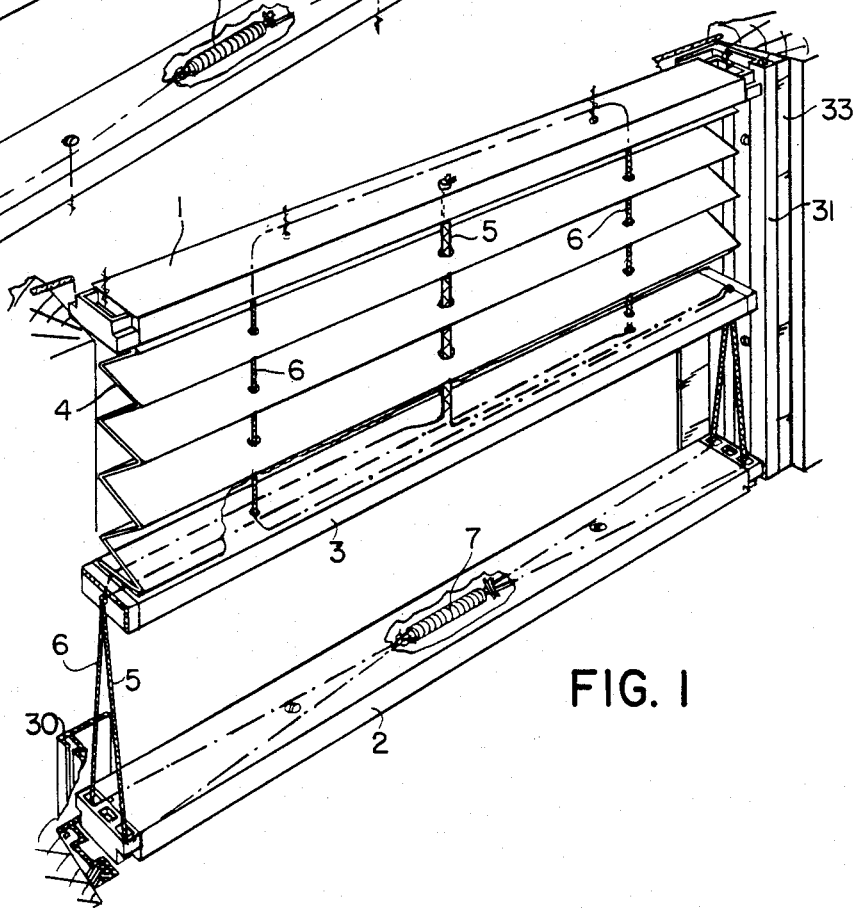
FIG. 1

FOLDING BLIND, COMPOSITE FOLDING BLIND AND COUPLING STRIP THEREFORE

This invention refers to a folding blind, consisting principally of a fixed top and bottom beam, and also a parallel thereto slidable along cords intermediate beam to which a panel of pleated material is fastened.

Folding blinds of the above kind are knwon in various embodiments, forms and patterns, the folding blind usually serving as a sunshade on a window.

In order to cover the window to a greater or lesser extent, the intermediate beam can be slid up or down along the cords, the pleats folding in or out like a concertina.

The invention has for its aim to so arrange the folding blind that the user has increased possibilites to arbitrarily cover the opening which is to be screened by the blind to a greater or lesser extent, covering the top, bottom or an intermediate part of that opening.

The folding blind according to the invention is distinguished in that the intermediate beam is divided into a first and a second intermediate beam, in which the second intermediate beam is slidable along cords parallel to or with the first one.

In a first embodiment the invention aims to provide a composite folding blind which consists of more than one folding blind of the type described above linked one above the other, whereby it is possible to select various patterns of folding blind according to the existing elements.

A coupling strip is preferentially thereby employed which couples the one blind to the intermediate beam of the other blind.

This coupling strip can moreover be provided with a fastening means for bringing about a fixed beam between the fixed top and bottom beams.

The coupling strip can also function as a stiffening strut to reinforce the intermediate beams against sagging, in cases of large lengths of beam or of excessive tension.

Finally, the intermediate beam is suitable for the attachment of handles or suchlike to make the operation thereof easier.

Since, owing to the use of the coupling strip, standard sectional strips can be utilized for the fixed and moveable beams of the folding blind, the cost can be reduced without diminishing the aesthetic appearance of the folding blind.

In another embodiment there is in each case a panel of material fitted between the fixed top and bottom beam and the first and second intermediate beam respectively. This produces in effect two folding blinds which can gradually cover the opening from below or above respectively. Moreover, it is possible to make the length of the folding blinds such that either one of them can cover the entire opening, it then being advantageous according to the invention to give each panel of material a different pattern or colour.

For high windows, the invention proposes applying in addition to the arrangement of guiding cords a second cord system which is fastened to the first and second intermediate beams, whereby the two beams are movable compulsorily opposite to each other. It is thereby possible when moving the lower intermediate beam upwards to move the upper intermediate beam downwards in a controlled manner.

Finally, the invention refers to cover strips fitted to the upright side walls of the folding blind, preferably L-section cover stripping being used which is also provided with a groove for the accommodation of filler strips. By this means the gap between the side of the window recess and the edge of the folding blind is optically closed up, while the filler strips serve to compensate the slant of the side of the recess relative to the window pane.

The invention will be further explained in the description with drawings, below, of several embodiments.

In the drawings:

FIG. 1 shows a perspective front view of a known folding blind, provided however with a cover strip along its upright side edge, FIG. 2 shows a perspective view, corresponding to FIG. 1, of a detail thereof, FIG. 3 shows a perspective front view of a folding blind according to the invention, FIG. 4 shows a perspective front view corresponding to FIG. 3 of a part of the folding blind from that figure, fitted in the recess of a window, FIG. 5 shows a view corresponding to FIG. 4 of a composite folding blind according to the invention, a coupling strip being employed, FIG. 6 shows perspective views of fastening means for the coupling strip, FIG. 7 shows a perspective view of the coupling strip as a stiffening member and equipped with a handgrip, as necessary for an intermediate beam for the folding blind of FIG. 3.

Figure 4:
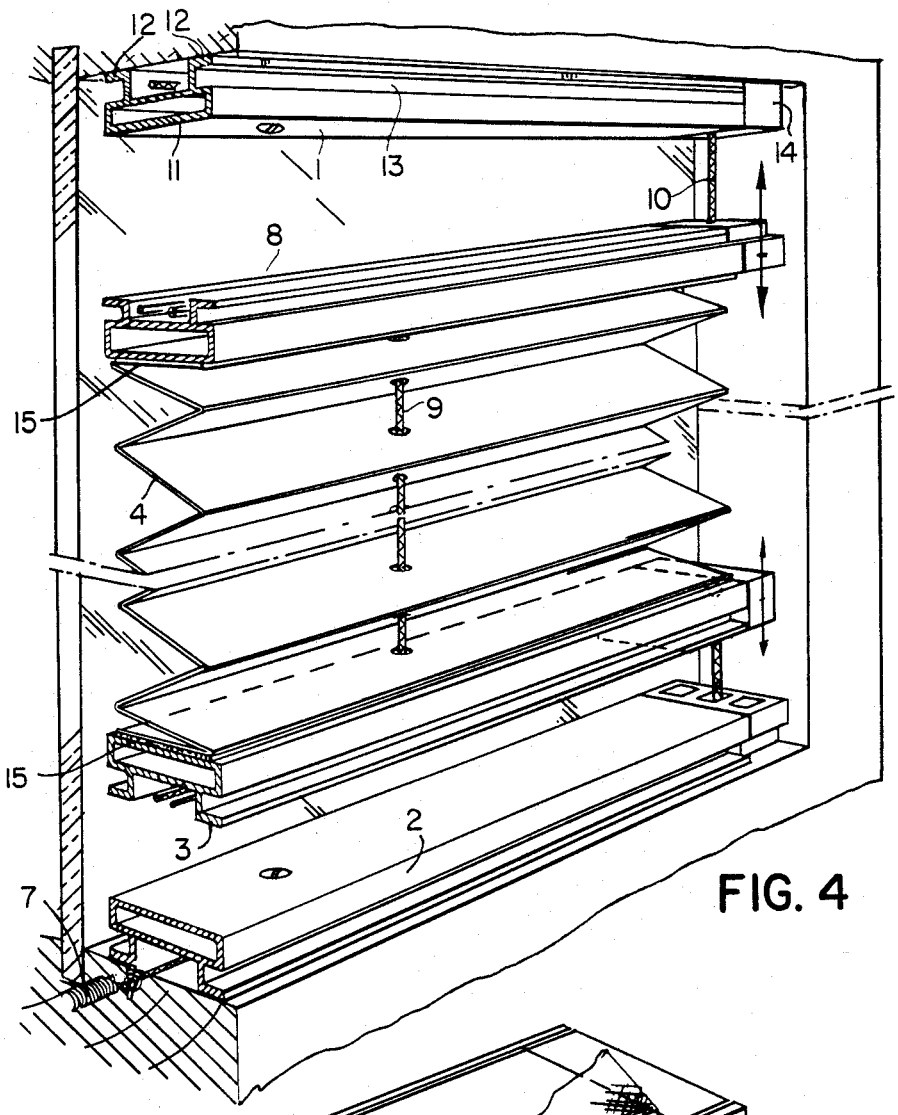

FIG. 1 shows a folding blind of the usual kind, consisting principally of a fixed top beam 1, a fixed bottom beam 2 and parallel slidable between them intermediate beam 3. Between fixed top beam 1 and intermediate beam 3, panel of pleated material 4 is fastened. Intermediate beam 3 is guided by means of cords 5,6, cord 5 running from the centre of top beam 1 via apertures in the pleated material through intermediate beam 3 to the sides thereof, and then along the side edges to bottom beam 2. Cord 6 runs from out of the bottom beam up along the side edge to intermediate beam 3, and then from the outer end thereof to a hole beyond the centre where the cord passes upwardly through corresponding apertures in the pleated material to the top beam (right-hand side of FIG. 1) and then returns downwardly through this top beam 1 to a second off-centre hole (left-hand side of FIG. 1) in mirror-image fashion to bottom beam 2. The ends of cords 5,6 are fastened to a tension spring 7 for keeping the cords under tension.

Owing to this routing of the cords, beam 3 can be moved up and down by hand, the pleats folding in or out respectively.

Figure 5:
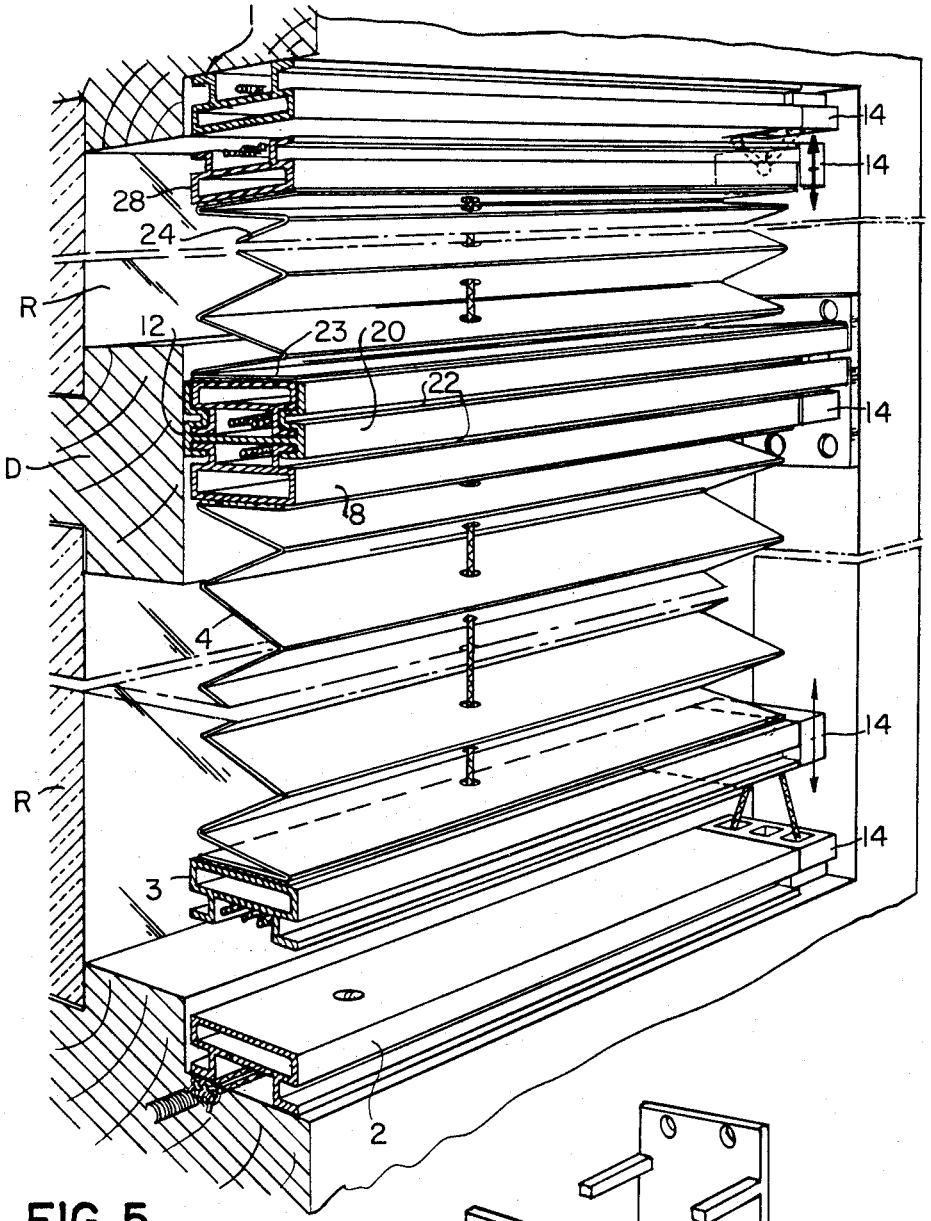

FIGS. 3, 4 and 5 show embodiments which are improved according to the invention with respect to the embodiment of FIG. 1 by the fitting of a second intermediate beam 8 parallel to intermediate beam 3. In these figures, the corresponding elements are labelled with the same reference numbers as in FIG. 1.

Owing to the changed cord routing, both intermediate beams 3 and 8 are slidable up and down parallel to each other and to the top and bottom beams, so that the folding blind can be folded away or out at the bottom as well as at the top. This offers the user the facility of closing off or covering either the bottom or the top of the window, as desired.

The cord system consists here of two cords 9,10 which are reeved in mirror-symmetrical fashion, each cord running from a tensioning member 7 in the top beam to the sides therof, and then to the side of intermediate beam 8, passing through beam 8 to a non-central opening thereof, via apertures in pleated material 4 to a corresponding opening in intermediate beam 3, then returning through beam 3 to the end thereof, and from there to the end of fixed bottom beam, where it is again fastened to a tensioning member 7.

It is also possible to elaborate cord 9 with an extra cord which, via an extra opening in intermediate beams 3,8 and pleated material 4, can function as an extra guide for this panel of material.

FIG. 4 shows in detail that the beams—fixed beams 1,2 as well as movable beams 3,8—all have the same cross-sectional form. This sectional form consists principally of a rectangular box-sectional strip 11, on a long rectangular side of which two angle-section strips 12 are fitted. The flanges of the angle-sections point outwards, each forming a longitudinal groove 13. The sectional strips are closed at the ends by end blocks 14 which also function to guide cords 9 and 10.

On the side opposite angle-sections 12, box-section 11 of movable beams 3,8 is fastened to an end strip 15 of pleated material 4.

The special shape of the beam is not only relatively rigid so that large stresses are possible while the dimensions are nonetheless small, but additionally the flanges of angle-sections 12 function for protection of cords 9,10 and accommodation of tensioning member 7, or or for coupling purposes as will be explained further below.

FIG. 5 shows an embodiment in which a composite folding blind is displayed.

Here there are two or more panels of pleated material of identical or of different patterns fitted before a window opening. The window consists here of two panes R situated one above the other, separated from each other by a cross-beam D.

In the embodiment according to FIG. 5, two panels of pleated material 4 and 24 are situated one above the other, the lower intermediate beam 23 of panel 24 being coupled to the upper intermediate beam 8 of pleated panel 4. This coupling is achieved through a coupling strip 20, which is further described below. With this coupling it is possible to enlarge or reduce pleated panel 24 by the sliding up or down of intermediate beam 28, the lower intermediate beam 3 of pleated panel 4 being similarly slidable up or down for reducing or enlarging pleated panel 4.

Figure 6:
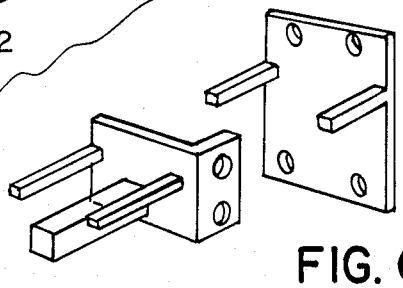

In the embodiment shown, intermediate beam 20 is secured to the side of the window recess by means of fastening means according to FIG. 6. It is however also possible to let composite beam 8,20,23 remain freely movable up and down.

If composite intermediate beam 8,20,23 is secured, a cord routing according to FIG. 1 can be applied to both the lower pleated panel and the upper pleated panel.

If however the intermediate beam is freely suspended, a cord routing according to FIG. 3 is preferable, each cord being routed for some distance through coupling strip 20 in order to obtain the necessary sliding resistance and for obtaining the self-braking effect for holding the beam at a determinate level.

Figure 7:
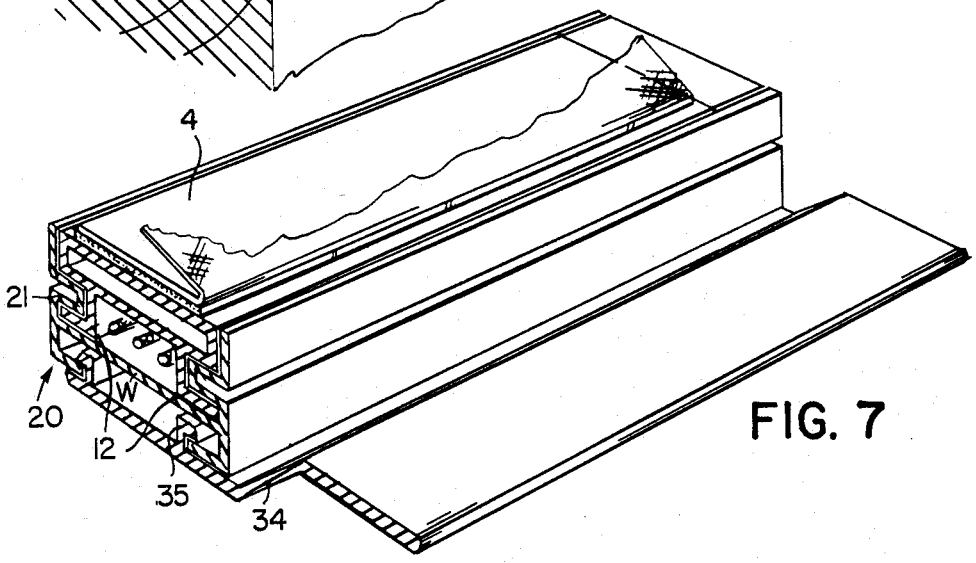

Coupling strip 20, which can be seen in detail in FIG. 7, consists principally of an H-sectional strip, legs 21 at the opposite sides of the Web W of the H-section being so shaped that the upper part thereof is complementary to the outward form of the above described fixed or moveable intermediate beam. The height of the top part of leg 21 covers the full height of the standard sectional strip of the folding blind, whereas the bottom part of shaped leg 21 encompasses only the hook-like flanges 12 (see FIG. 5). This causes an intermediate beam 8,20,23 to be visible which displays outwardly two grooves 22, one above the other, giving the bar a slim appearance which is aesthetically pleasing.

The bottom part of shaped leg 21 of H-section coupling strip 20 can also serve for the attachment of handgrip section 34 (see FIG. 7), strip 20 then being usable as a covering and/or stiffening strip for single intermediate beam 3,8 of FIG. 3. By this means the cords are concealed between angle flanges 12. Handgrip section 34 can have an arbitrary length and, owing to the small hooked ribs 35, can be snapped between the turned-over parts of shaped legs 21 at arbitrary positions.

Returning to FIGS. 1 and 2, it should be observed that between the window recess and pleated panel 4 there remains a slit-shaped gap through which light can pass. In order to close off this gap, the invention proposed fitting a principally L-section strip along the inner side of window recess R. L-section cover strip 30 in FIG. 1 is shown in detail in FIG. 2. The one leg extends parallel to the window pane or to pleated panel 4, while the other leg extends along the inner side of recess R and also continues for the full height of fixed top and bottom bars 1,2.

Since in many cases window recess R displays a surface slanting with respect to the window-pane, leg 31 of sectional strip 30 which extends over that surface is made with two grooves 32 close to the long edges thereof. In a groove there can be fitted filler strip 33, which also extends for the full height of the cover strip (see right in FIG. 1). In this way a close-fitting joint is obtained between strip 30 and window recess R.

If required, the cover strip can also be fitted in a reversed sense along recess R, the leg parallel to the window-pane being situated in front of pleated panel 4. In this case, filler strip 33 in groove 32 should be fitted into the groove 32 next to the corner of the L-section to allow for the slanting orientation of the inside of the window recess.

It will be clear that cover strip 30 can also be applied to the folding blind illustrated in the other figures.

Figure 8:
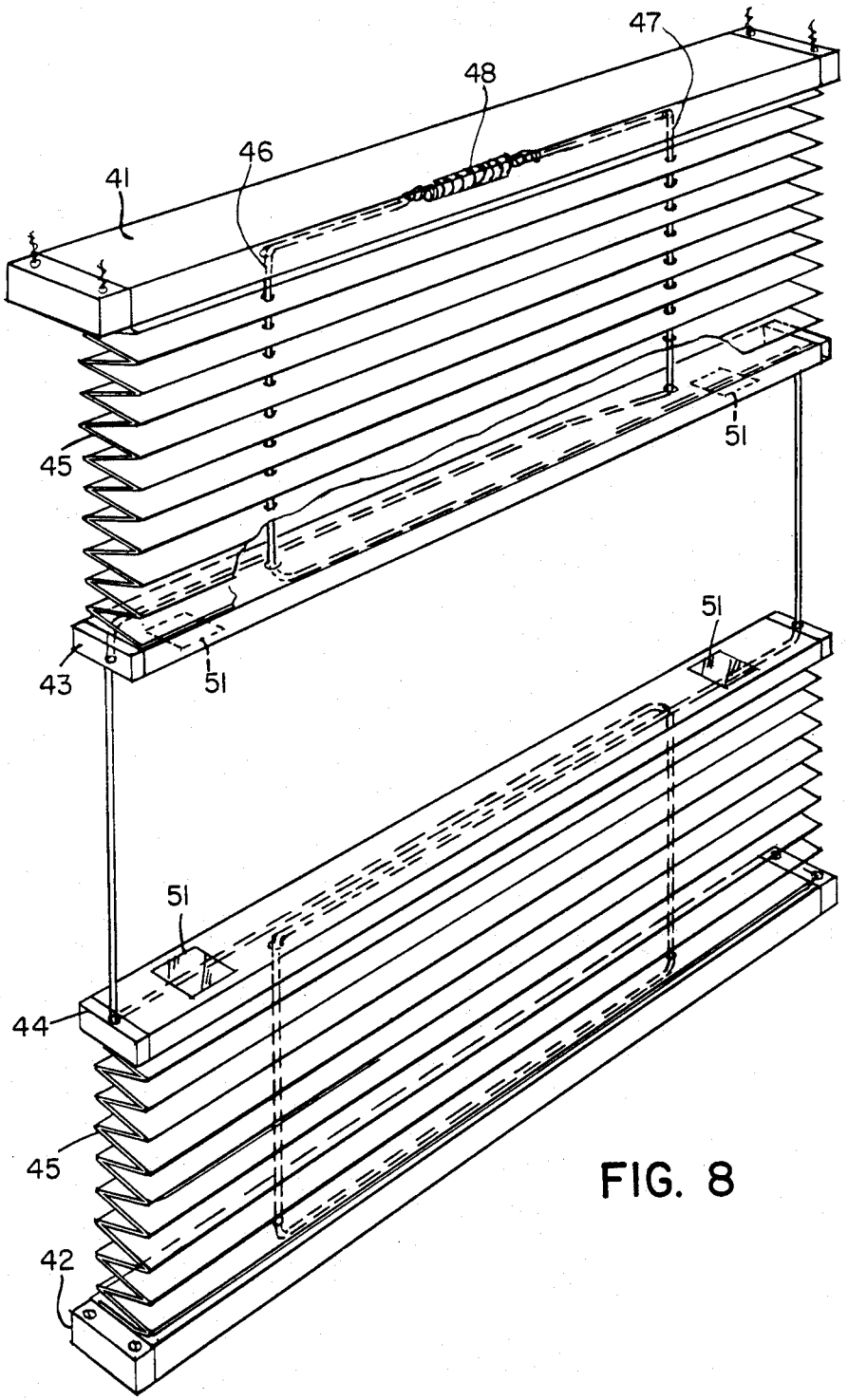
FIG. 8 shows a perspective view of a first embodiment in which the two folding blinds are freely movable with respect to each other.
Figure 9:
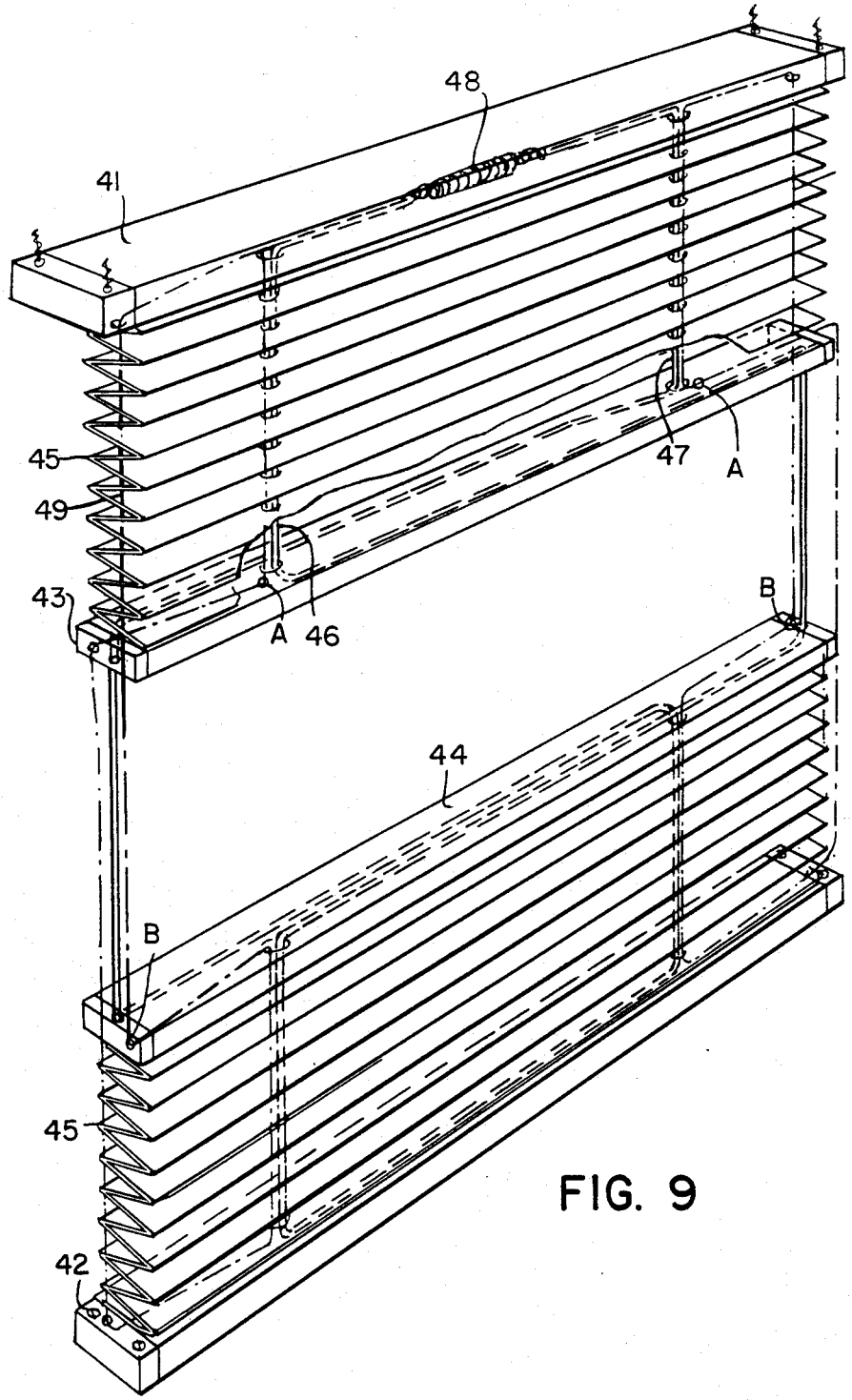
FIG. 9 shows in a front view a folding blind corresponding to FIG. 1, the intermediate beams being however coupled by a cord system.

In FIGS. 8 and 9 the corresponding parts are indicated by the same reference numbers.

The blind according to the invention consists of a top beam 41 and a bottom beam 42 which are assumed to be fastened in a known way to the framework of a window or opening. The fastening can take place in an arbitrary way, for example with screws.

The movable intermediate beam is according to the invention divided into a first intermediate beam 43 and a second intermediate beam 44, a panel of pleated material 45 being fitted between beams 41, and 43, the same being done between beams 42 and 44.

Movable beams 43 and 44 are guided with respect to fixed beams 41 and 42 via a cord guidance system 46 and 47, cords 46 and 47 being reeved symmetrically with respect to an imaginary mirror plane. The ends of both cords are fastened to a tension spring 48 in order to maintain the cords under tension. Cords 46 and 47 are joined together at their bottom ends so that one cord is in fact sufficient, or both cords are knotted together, or are fastened to bottom beam 42.

According to a characteristic of the invention, the two beams 43 and 44 can be coupled together, for example by means of magnetic fastener 51, so that in that condition the entire window opening is covered by the two pleated panels 45. By detaching the beams from each other, the upper and lower portions of the opening can each be wholly or partially covered.

It is also possible to make pleated panels 45 of such length that one panel covers the entire window opening, so that by sliding of beams 43 and 44 up or down the window opening is covered by a panel of a single pattern or colour. This is particularly of interest if panels 45 differ from each other in pattern or colour, it being also possible to use a day blind and a night blind.

The embodiment of FIG. 9 is distinguished from that of FIG. 1 in that in addition to the normal guidance cord system 46, 47 of FIG. 8 an extra cord system 49, 50 is fitted, whereof the cords also pass through suitable openings in the panel material and the beams. Cords 49 and 50 are both attached to beam 43 at A and beam 44 at B, and are so routed via fixed beams 41 and 42 that on raising beam 44, beam 43 is automatically moved downwards. Obviously if beam 43 is manipulated in an upward or downward direction, beam 44 will move downwards or upwards respectively.

In the above description it is taken that the blind is applied to a vertically disposed window opening. It is clear that the blind can also be used for a sloping or horizontally inclined window opening to obtain the same effect.

The invention is further not limited to the above-described embodiments.

I claim:

1. A folding blind comprising first and second main beams disposed in generally parallel relation, the two main beams being fixed relative to each other to define a space of fixed area therebetween, first intermediate beam means and second intermediate beam means, the two intermediate beam means being disposed between the main beams in generally parallel relation to each other and to the main beams, cord means tensioned between said main beams in slidable, frictional engagement with said first and second intermediate beam means for guiding said intermediate beam means between positions of relative displacement therebetween, and pleated panel means responsive to positioning of said intermediate beam means for defining at least one blinding space of variable area within said space of fixed area.

2. A folding blind as defined in claim 1 wherein said panel means extends between said intermediate beam means.

3. A folding blind as defined in claim 1 wherein said panel means comprises a first panel extending between said first intermediate beam means and said first main beam and a second panel extending between said second intermediate beam means and said second main beam.

4. A folding blind as defined in claim 1 wherein said first intermediate beam means is of composite construction comprising a pair of intermediate beams and a coupling piece joining such pair of intermediate beams.

5. A folding blind as defined in claim 4 wherein said first intermediate beam means includes mechanism fixing it is position relative to said main beams.

6. A folding blind as defined in claim 4 wherein said coupling piece is of H-shaped cross-section, the legs of the H being so shaped that one intermediate beam of said pair thereof is entirely enveloped and the other is partially gripped.

7. A folding blind as defined in claim 4 wherein said coupling piece is provided with a hand grip.

8. A folding blind as defined in claim 1 wherein said cord means constrains said intermediate beam means to move in relatively opposite directions.

9. A folding blind assembly fitted within a window opening and comprising first hollow main beam means and second hollow main beam means delineating opposite ends of the window opening and defining the window viewing space therebetween, first hollow intermediate beam means and second hollow intermediate beam means, the two intermediate beam means being disposed between the main beam means in generally parallel relation to each other and to the main beam means so that opposite ends of all of the beam means are in alignment to define opposite side spaces at opposite sides of the window opening through which light may penetrate even in the presence of a blinding panel, accordion pleated panel means extending between at least one pair of beam means and responsive to movements between such pair of beam means to define a blinding space of variable area within said window opening, cord means tensioned between said main beam means and passing in slidable, frictional engagement through said beam means for guiding said intermediate beam means between positions of relative displacement therebetween and for defining flights of such cord means at the ends of said pair of beam means which are disposed within said opposite side spaces to clear said panel means.

10. A folding blind assembly as defined in claim 9 wherein there are two pairs of said beam means and two of said panel means extending respectively therebetween.

11. A folding blind assembly as defined in claim 10 wherein said panel means are made of material having different patterns or colors.

12. A folding blind assembly as defined in claim 9 including an L-sectional cover strip extending along each of said opposite side spaces.

13. A folding blind assembly as defined in claim 12 wherein each cover strip is provided with one or more grooves for accommodating a filler strip.

14. A folding blind comprising a fixed top beam and a fixed bottom beam defining a sight area therebetween, cord means connected between the top and bottom beams, a pair of spaced apart relatively movable intermediate beam means disposed between the top and bottom beams and guided on the cord means for movements between widely spaced, parallel positions adjacent the respective top and bottom beams and closely spaced positions relative to each other, and pleated panel means connected to the pair of intermediate beam means for expansion and contraction in response to parallel movements between the pair of intermediate beam means to block off more or less of the sight area.

15. A folding blind as defined in claim 14 wherein the panel means comprises a single pleated panel secured between the pair of intermediate beam means.

16. A folding blind as defined in claim 14 wherein the panel means comprises a pair of pleated panels, one of which is secured between the top beam and one of the intermediate beam means and the other of which is secured between the bottom beam and the other of the intermediate beam means.

17. A folding blind as defined in claim 16 wherein each pleated panel is of an unfolded length substantially equal to the sight area height whereby either pleated panel may be disposed in sight area covering relation.

* * * * *